United States Patent [19]

Yff

[11] Patent Number: 4,750,689

[45] Date of Patent: Jun. 14, 1988

[54] SYSTEM FOR DETERMINING THE ANGULAR SPIN POSITION OF AN OBJECT SPINNING ABOUT AN AXIS

[75] Inventor: Louis S. Yff, Hengelo, Netherlands

[73] Assignee: Hollandse Signaalapparaten B.V., Hengelo, Netherlands

[21] Appl. No.: 26,818

[22] Filed: Mar. 17, 1987

[30] Foreign Application Priority Data

Mar. 20, 1986 [NL] Netherlands ..... 8600710

[51] Int. Cl.[4] ..... F41G 7/30

[52] U.S. Cl. ..... 244/3.14; 244/3.21

[58] Field of Search ..... 244/3.21, 3.22, 3.11, 244/3.14, 3.13

[56] References Cited

U.S. PATENT DOCUMENTS

| | | | |
|---|---|---|---|
| 2,997,255 | 8/1961 | George | 244/3.13 |
| 2,998,942 | 9/1961 | Kuck | 244/3.11 |
| 3,025,024 | 3/1962 | Hawes | 244/3.13 |
| 3,133,283 | 5/1964 | Ghose | 343/100 |
| 3,947,770 | 3/1976 | Cavanagh et al. | 343/703 |
| 3,963,195 | 6/1976 | Coxe et al. | 244/3.11 |
| 4,219,170 | 8/1980 | Esker | 244/3.14 |
| 4,328,938 | 5/1982 | Reisman et al. | 244/3.21 |

FOREIGN PATENT DOCUMENTS

| | | | |
|---|---|---|---|
| 1168513 | 4/1964 | Fed. Rep. of Germany | 244/3.13 |
| 2436433 | 4/1980 | France . | |

*Primary Examiner*—Charles T. Jordan
*Attorney, Agent, or Firm*—Robert J. Kraus

[57] ABSTRACT

The invention relates to a system for determining the angular spin position of an object (1) spinning about an axis. The system thereto comprises means (7) for transmitting at least two superimposed phase-locked and polarized carrier waves to obtain the angular spin position. The system further comprises at least two loop antennas (10), connected to the object (1), and receiving means (13) for processing in combination the antennas-received signals.

15 Claims, 9 Drawing Sheets

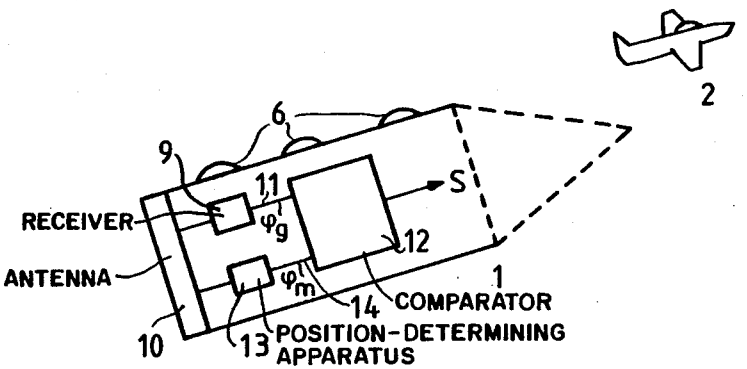
Fig. 1
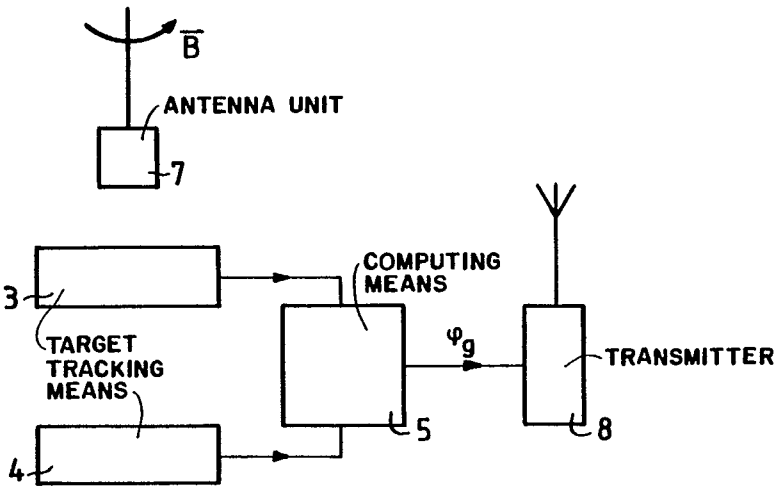

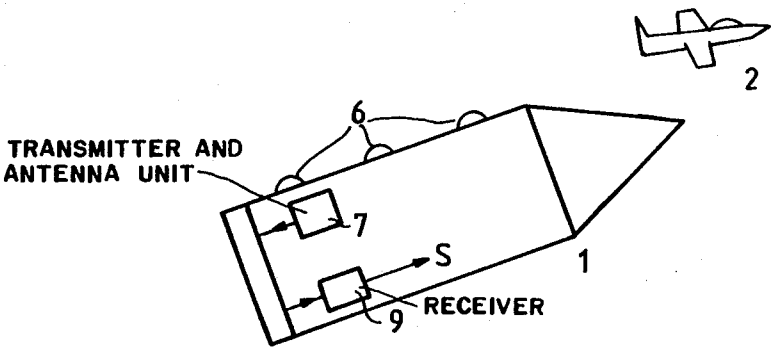
Fig. 7
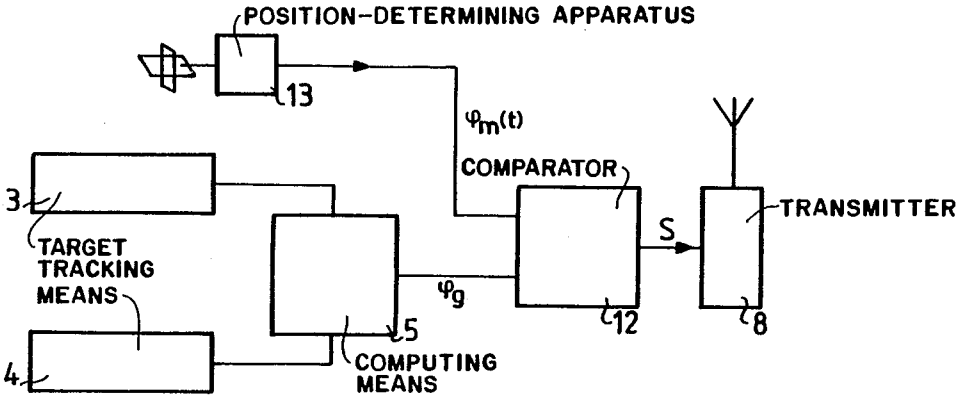

SYSTEM FOR DETERMINING THE ANGULAR SPIN POSITION OF AN OBJECT SPINNING ABOUT AN AXIS

BACKGROUND OF THE INVENTION

The invention relates to a system for determining the angular spin position of a second object spinning about an axis with respect to a first object. The invention also relates to a first and a second object, which are suitable for use in said system. Such a system is of prior art regarding the second object, where a position indicator fitted thereon can clearly be localised on the second object. Hence, this usually concerns objects located in the direct vicinity of the first object (the measuring position). Such a system however cannot be applied to a remote second object, as a position indicator fitted thereon can no longer be localised from the measuring position. In case of fired projectiles, such as shells, it is often desirable to change the course during the flight. However, since a shell spins about its axis along the trajectory, correction of its course is effective only if at any random instant the associated spin or roll position is well-known. Suitable course correction means for this purpose are preferably based on principles of the aerodynamics, the chemistry, the gas theory and the dynamics. In this respect, considered are the bringing out of damping fins or surfaces on the projectile's circumferential surface, the detonation of small charges on the projectile, and the ejection of a small mass of gas from the projectile.

SUMMARY OF THE INVENTION

The present invention has for its object to provide a solution to the problem as regards the determination of the angular spin or roll position of a remote second object with respect to a first object.

The invention is based on the idea of providing the second object with an apparatus for determining the instantaneous, relative angular spin position of the second object with respect to the first object, using an antenna signal transmitted by the first object as reference.

According to the invention set forth in the opening paragraph, the system thereto comprises at least two loop antennas connected to the second object; transmitting means for generating at least two superimposed phase-locked and polarised carrier waves with different frequencies; and receiving means for processing in combination the carrier waves received from said loop antennas to obtain said angular spin position.

Radio navigation teaches that an angular spin position of a vessel can be determined by means of two loop antennas, of which the axis of rotation is taken up by a vertical reference antenna, while elsewhere the first object transmits one carrier wave as reference. Since with the use of two loop antennas for determining the angular spin position an uncertainty of 180° in this position is incurred, a reference antenna is needed to eliminate this uncertainty. Such a method is unusable for a projectile functioning as second object. Because a projectile spins during its flight, the reference antenna can only be fitted parallel to the projectile axis of rotation. Since a projectile generally flies away from the gun that fired it, while a unit for the transmission of the carrier wave is positioned at a relatively short distance from the gun, the electric-field component of the carrier wave will be normal or substantially normal to the reference antenna axis if the projectile is near the target at a relatively long distance from the gun. Consequently, there will be no or hardly any output signal at the reference antenna, making this antenna unusable.

The above drawbacks do not prevail in the system according to the present invention, because no reference antenna is utilised.

BRIEF DESCRIPTION OF THE DRAWING

The invention will now be described in more detail with reference to the accompanying drawings, of which:

FIG. 1 is a schematic representation of a first embodiment of a complete system for the control of a projectile functioning as second object;

FIG. 7 is schematic representation of a second embodiment of a complete system for the control of a projectile functioning as first object;

DESCRIPTION OF THE PREFERRED EMBODIMENTS

Figure 2:
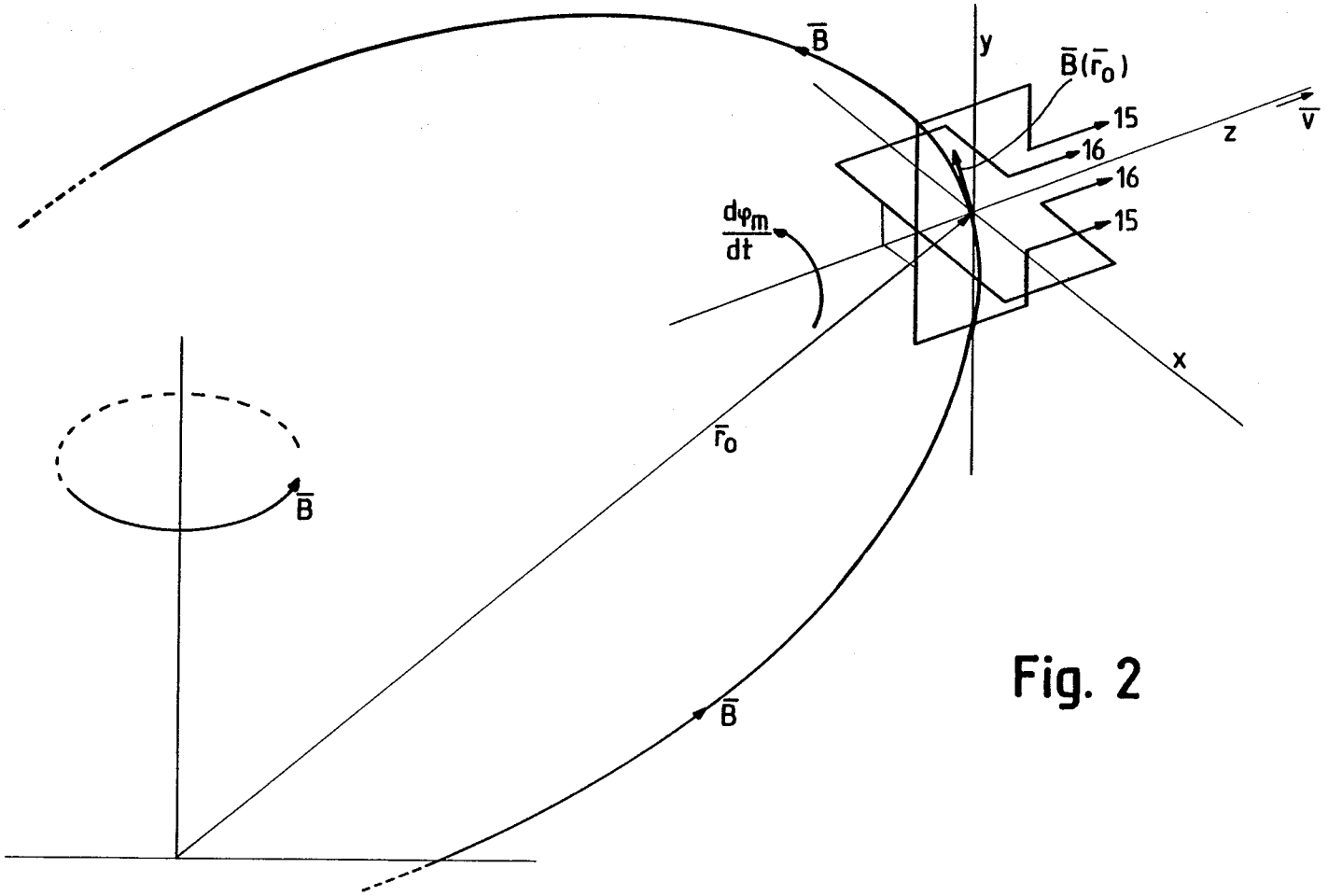
FIG. 2 is a schematic representation of two perpendicularly disposed loop antennas placed in an electromagnetic field.

In FIG. 1 it is assumed that a projectile 1 functioning as second object has been fired to hit a target 2. The target trajectory is tracked from the ground with the aid of target tracking means 3. For this purpose, use may be made of a monopulse radar tracking unit operable in the K-band or of pulsed laser tracking means operable in the far infrared region. The trajectory of projectile 1 is tracked with comparable target tracking means 4. From the information of supplied target positions determined by target tracking means 3 and from supplied projectile positions determined by target tracking means 4 computing means 5 determines whether any course corrections of the projectile are necessary. To make a course correction, the projectile is provided with gas discharge units 6. Since the projectile rotates about its axis, a course correction requires the activation of a gas discharge unit at the instant the projectile assumes the correct position. To determine the correct position, carrier waves sent out by a transmitter and antenna unit 7 functioning as first object are utilised. Computing means 5 determines the desired projectile angular spin position $\phi_g$ at which a gas discharge should occur with respect to (a component of) the electromagnetic field pattern $\overline{B}$ of the carrier waves at the projectile position. The position and attitude of the transmitter and antenna unit 7 serve as reference for this purpose. This is possible, because the field pattern and the projectile position in this field are known. The calculated value $\phi_g$ is sent out with the aid of transmitter 8. A receiver 9, accommodated in the projectile, receives from antenna means 10 the value of $\phi_g$ transmitted by transmitter 8. The received value $\phi_g$ is supplied to a comparator 12 via line 11. An apparatus 13, fed with the antenna signals of two perpendicularly disposed loop antennas contained in antenna means 10, determines the instantaneous projectile position $\phi_m(t)$ with respect to the electromagnetic field at the location of the loop antennas. The instantaneous value $\phi_m(t)$ is supplied to comparator 12 via line 14. When the condition $\phi_m(t)=\phi_g$ has been fulfilled, comparator 12 delivers a signal S to activate the gas discharge unit 6. At this moment a course correction is made. Thereafter this entire process can be repeated if a second course correction is required.

It should be noted that it is also possible to make the desired course corrections without the use of second target tracking means 4. The target tracking means 3 thereto measures the target trajectory. From the measuring data of the target trajectory the computing means 5 makes a prediction of the rest of the target trajectory. Computing means 5 uses this predicted data to calculate the direction in which the projectile must be fired. The projectile trajectory is calculated by computing means 5 from the projectile ballistic data. The target tracking means 3 keeps tracking the target 2. If it is found that target 2 suddenly deviates from its predicted trajectory, computing means 5 calculates the projectile course correction to be made. It is thereby assumed that the projectile follows its calculated trajectory. If the projectile in flight nears the target, this target will also get in the beam of the target tracking means 3. From this moment onward it is possible to track both the target and the projectile trajectories, permitting computing means 5 to make some projectile course corrections, if necessary. As a result, any deviations from the calculated projectile trajectory, for example due to wind, are corrected at the same time.

It is also possible to eliminate the second tracking means 4 with the application of a time-sharing system. In such a case, the target and the projectile trajectories are tracked alternately by means of target tracking means 3. Any course corrections of the projectile are made analogously, as described hereinbefore.

Figure 3:
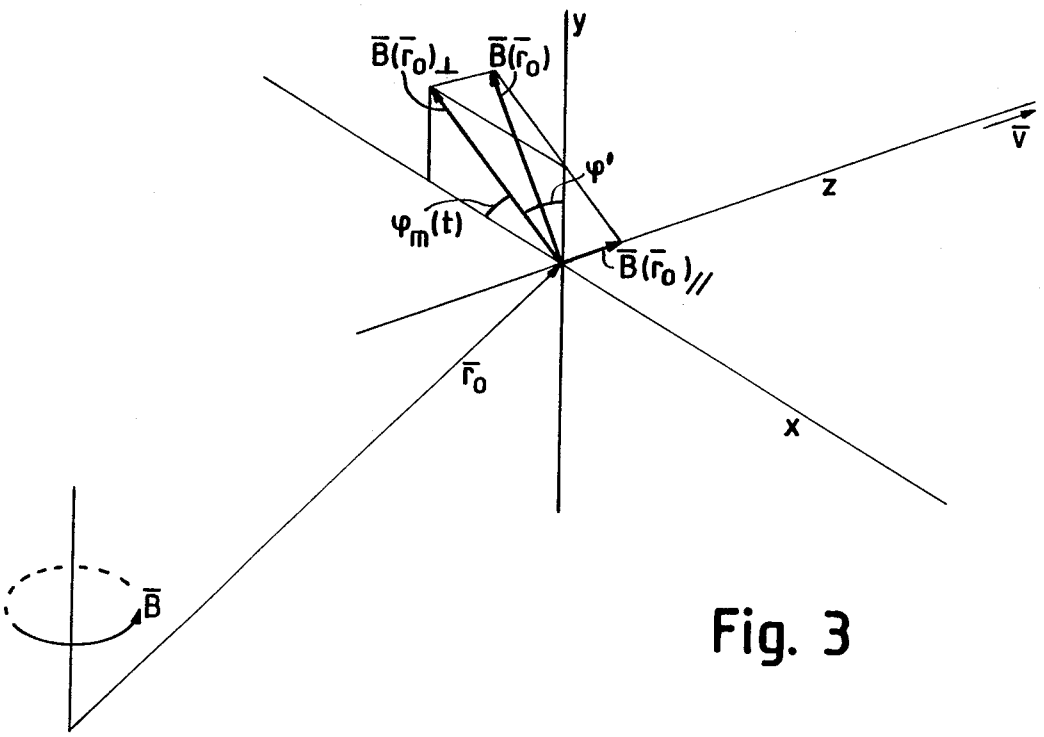
FIG. 3 is a diagram of a magnetic field at the location of the loop antennas.

FIG. 2 shows the two perpendicularly disposed loop antennas 15 and 16, forming part of the antenna means 10. An x,y,z coordinate system is coupled to one of the loop antennas. The propagation direction $\bar{v}$ of the projectile is parallel to the z-axis. The magnetic field component $\bar{B}$, transmitted by transmitter 7 has the magnitude and direction $\bar{B}(\bar{r}_o)$ at the location of the loop antennas. Here $\bar{r}_o$ is the vector with the transmitter and the antenna unit 7 as origin and the origin of the x,y,z coordinate system as end point. The magnetic field component $\bar{B}(\bar{r}_o)$ can be resolved into a component $\bar{B}(\bar{r}_o)_{\parallel}$ (parallel to the z-axis) and the component $\bar{B}(\bar{r}_o)_{\perp}$ (perpendicular to the z-axis). Only the components $\bar{B}(\bar{r}_o)_{\perp}$ can generate an induction voltage in the two loop antennas. Therefore, as reference for the determination of $\phi_m(t)$ use is made of $\bar{B}(\bar{r}_o)_{\perp}$. In this case, $\phi_m(t)$ is the angle between the x-axis and $\bar{B}(\bar{r}_o)_{\perp}$, see FIG. 3. Since computing means 5 is capable of calculating $\bar{v}$ from the supplied projectile positions $\bar{r}$, computing means 5 can also calculate $\bar{B}(\bar{r}_o)_{\perp}$ from $\bar{B}(\bar{r}_o)$ and define $\phi_g$ with respect to this component. It is of course possible to dimension the transmitter and antenna unit 7 in such a way that the associated field pattern assumes a simple form at some distance from the antenna, enabling computing means 5 to make only simple calculations. This is however not the objective of the patent application in question. It is only assumed that $\bar{B}(\bar{r}_o)$ is known. It is possible to select other positions of the x,y,z coordinate system. The only condition is that the x- and y-axes are not parallel to the propagation direction ($\bar{v}$), as in such a case one of the two antennas will not generate an induction voltage.

Figure 4:
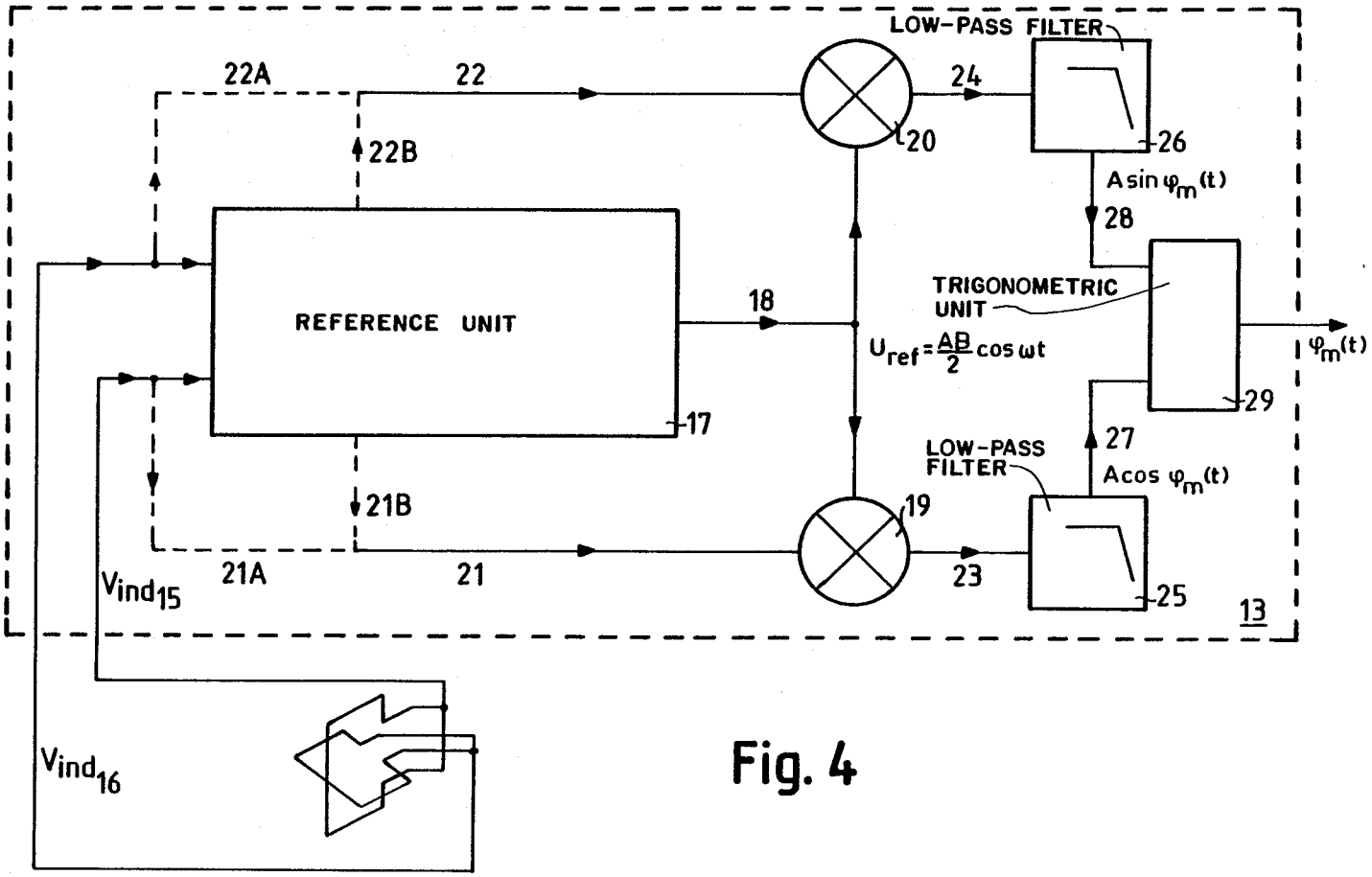
FIG. 4 shows a first embodiment of an apparatus included in a projectile to determine the angular spin position of the projectile.

FIG. 4 is a schematic representation of the apparatus 13. In the embodiment of apparatus 13 in FIG. 4 it is assumed that the transmitter sends out an electro-magnetic field consisting of two superimposed phase-locked and polarised carrier waves. A first carrier wave has a frequency $n\omega_o$ and the second carrier wave a frequency $(n+1)\omega_o$, where $n=1, 2, \ldots$. The magnetic field component $\bar{B}_{\perp}(\bar{r}_o)$ can be defined as $\bar{B}_{\perp}(\bar{r}_o)=(a \sin n\omega_o t+b \sin (n+1)\omega_o t)\bar{e}$, where $$\frac{B_{\perp}(r_o)}{|B_{\perp}(r_o)|} = e.$$

The magnetic flux $\phi_{15}$ through the loop antenna 15 can be defined as:

$$\phi_{15}=(a \sin n\omega_o t+b \sin (n+1)\omega_o t).O.\cos \phi_m(t) \quad (1)$$

In this formula, O is equal to the area of the loop antenna 15.

The magnetic flux $\phi_{16}$ through loop antenna 16 can be defined as:

$$\phi_{16}=(a \sin n\omega_o t+b \sin (n+1)\omega_o t).O.\sin \phi_m(t) \quad (2)$$

The induction voltage in loop antenna 15 is now equal to $$\begin{aligned} V_{ind15}(t) &= -\epsilon \frac{d\phi}{dt} \equiv -\epsilon(an\omega_o \cos n\omega_o t + \\ &\quad b(n+1)\omega_o \cos(n+1)\omega_o t) \cdot 0 \cdot \cos\phi_m(t) + \\ &\quad -\epsilon(a \sin n\omega_o t + b \sin(n+1)\omega_o t) \cdot 0 \cdot \\ &\quad \sin\phi_m(t) \cdot \frac{d\phi_m}{dt} \end{aligned} \quad (3)$$

Here $\epsilon$ is a constant which is dependent upon the used loop antennas 15, 16.

Since the projectile speed of rotation $$\frac{d\phi_m}{dt}$$

is much smaller than the angular frequency $\omega_o$, it can be approximated that:

$$V_{ind15}(t)=-\epsilon(a\, n\omega_o \cos n\omega_o t+b(n+1)\omega_o \cos (n+1)\omega_o(t).0.\cos \phi_m(t)=(A \cos n\omega_o t+B \cos (n+1)\omega_o t).\cos \phi_m(t) \quad (4)$$

Similarly, for loop antenna 16:

$$V_{ind16}(t)=(A \cos n\omega_o t+B \cos (n+1)\omega_o t).\sin \phi_m(t) \quad (5)$$

In apparatus 13 (FIG. 4) the induction voltages $V_{ind15}$ and $V_{ind16}$ are supplied to the reference unit 17.

Using the signals $V_{ind15}(t)$ and $V_{ind16}(t)$, reference unit 17 generates a reference signal $U_{ref}$, which may be expressed by:

$$U_{ref}=C \cos n\omega_o t \quad (6)$$

Here C is a constant which is dependent upon the specific embodiment of the reference unit. The $U_{ref}$ signal is supplied to mixers 19 and 20 via line 18. Signal $V_{ind15}(t)$ is also applied to mixer 19 via lines 21A and 21. The output signal of mixer 19 is applied to low-pass filter 25 via a line 23. The output signal $U_{25}(t)$ of the low-pass filter 25 (the component of frequency $$\left(\frac{d\phi_m}{dt}\right)$$

is equal to:

$$U_{25}(t) = \frac{AC}{2}\cos\phi_m(t) \tag{7}$$

In a fully analogous way, signal $V_{ind16}(t)$ is fed to mixer 20 via lines 22A and 22. The output signal of mixer 20 is fed to a low-pass filter 26 via line 24. Output signal $U_{26}(t)$ of the low-pass filter 26 is equal to:

$$U_{26}(t) = \frac{AC}{2}\sin\phi_m(t) \tag{8}$$

From formulas 7 and 8 and for a given $U_{25}(t)$ and $U_{26}(t)$, it is simple to determine $\phi_m(t)$. To this effect, signals $U_{25}(t)$ and $U_{26}(t)$ are sent to a trigonometric unit 29 via lines 27 and 28. In response to these signals, trigonometric unit 29 generates $\phi_m(t)$. Trigonometric unit 29 may, for instance, function as a table look-up unit. It is also possible to have the trigonometric unit functioning as a computer to generate $\phi_m(t)$ via a certain algorithm.

Figure 5:
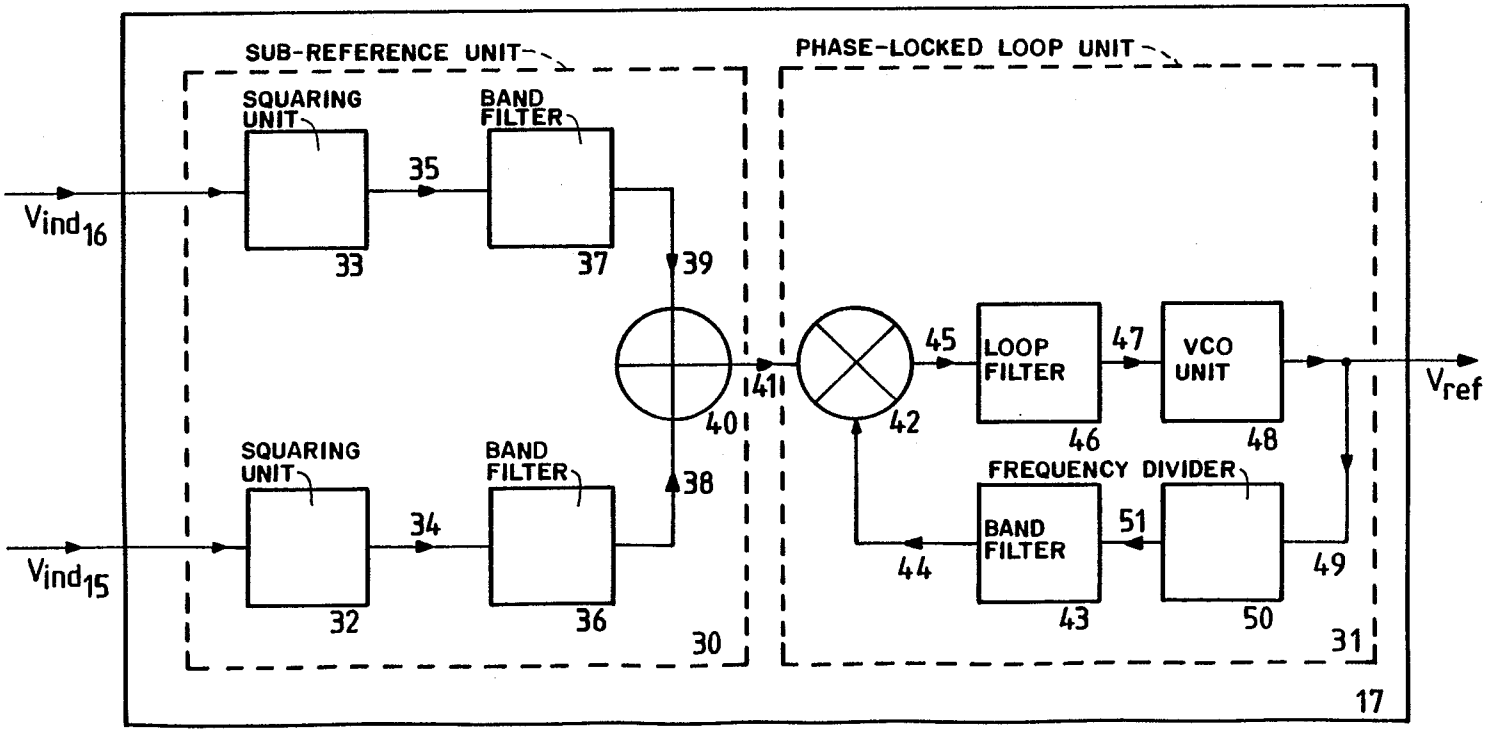
FIG. 5 is a first embodiment of a unit from FIG. 4.

With a special embodiment of reference unit 17, lines 21A and 22A can be removed and replaced by lines 21B and 22B. A special embodiment of reference unit 17, in which lines 21A and 22A are not removed, is shown in FIG. 5. Reference unit 17 consists of a sub-reference unit 30 and a phase-locked loop unit 31. From $V_{ind15}(t)$ and $V_{ind16}(t)$ the sub-reference unit 30 generates a signal $$U'_{ref} = \frac{AB}{2}\cos\omega_o t.$$

Unit 31 generates the afore-mentioned signal $$U_{ref} = \frac{AB}{2}\cos n\omega_o t \text{ from signal } U'_{ref}.$$

Sub-reference unit 30 is provided with two squaring units 32 and 33 to square the signals $V_{ind15}(t)$ and $V_{ind16}(t)$, respectively.

Squaring unit 32 thus generates the signal:

$$\begin{aligned} U_{32}(t) = V^2_{ind15}(t) \;=\; & A^2\sin^2\phi_m(t)(\tfrac{1}{2} + \tfrac{1}{2}\cos 2n\omega_o t) + \\ & AB\sin^2\phi_m(t)(\tfrac{1}{2}\cos\omega_o t + \\ & \tfrac{1}{2}\cos(2n+1)\omega_o t) + \\ & B^2\sin^2\phi_m(t)(\tfrac{1}{2} + \tfrac{1}{2}\cos(2n+2)\omega_o t) \end{aligned} \tag{9}$$

while squaring unit 33 generates the signal:

$$\begin{aligned} U_{33}(t) = V^2_{ind16}(t) \;=\; & A^2\cos^2\omega_m(t)(\tfrac{1}{2} + \tfrac{1}{2}\cos 2n\omega_o t) + \\ & AB\cos^2\phi_m(t)(\tfrac{1}{2}\cos\omega_o t + \\ & \tfrac{1}{2}\cos(2n+1)\omega_o t) + \\ & B^2\sin^2\phi_m(t)(\tfrac{1}{2} + \tfrac{1}{2}\cos(2n+2)\omega_o t) \end{aligned} \tag{10}$$

The output signal of squaring units 32 and 33 is applied to a band filter 36 and 37 via lines 34 and 35, respectively. Band filters 36 and 37 pass only signals at a frequency equal or substantially equal to $\omega_o$. The signal obtained at the output of band filter 36 is (see formula (9)):

$$U_{36}(t) = AB\sin^2\phi_m(t).\tfrac{1}{2}\cos\omega_o t \tag{11}$$

Also for formula (11) it is assumed that $$\frac{d\phi_m(t)}{dt} << \omega_o.$$

In a fully analogous way, band filter 37 produces the output signal (see formula (10)):

$$U_{37}(t) = AB\cos^2\phi_m(t).\tfrac{1}{2}\cos\omega_o t \tag{12}$$

Signals $U_{36}(t)$ and $U_{37}(t)$ are applied to summing unit 40 via lines 38 and 39, respectively, to produce the sum signal (see formulas (11) and (12):

$$U'_{ref}(t) = U_{40}(t) = \frac{AB}{2}\cos\omega_o t \tag{13}$$

Signal $U'_{ref}(t)$ is sent to the phase-locked loop unit 31 via line 41. Input signal $U'_{ref}(t)$ of unit 31 is applied to a mixer 42 via line 41. Supposing that the second input signal of mixer 42, the output signal $U_{43}(t)$ of band filter 43 passing only signals with a frequency equal or substantially equal to $\omega_o$ for application to mixer 42 via line 44, takes the form of:

$$U_{43}(t) = D\cos\omega t \tag{14}$$

where D is a random constant. In such a case, the output signal of mixer 42 is:

$$U_{42}(t) = \frac{ABD}{2}\cos\omega t\cos\omega_o t \tag{15}$$

Signal $U_{42}(t)$ is applied to a loop filter 46 via line 45. The loop filter output signal $U_{46}(t)$ is equal to:

$$U_{46}(t) = E.(\omega_o - \omega) \tag{16}$$

where E is a constant depending upon the filter used. Signal $U_{46}(t)$ is fed to VCO unit 48 via line 47. The VCO unit generates an output signal, expressed by:

$$U_{48}(t) = K\cos(\omega'_o + k\,E(\omega_o - \omega))t \tag{17}$$

In the above expression, $\omega'_o$, k and K are constants, where $\omega' = \omega_o n$. Signal $U_{48}(t)$ is sent to a frequency divider (n) 50 via line 49. The frequency divider output signal is expressed by:

$$U_{50}(t) = K\cos\left(\omega_o + \frac{kE}{n}(\omega_o - \omega)\right)t \quad (18)$$

The output signal $U_{50}(t)$ is applied to a band filter 43 via line 51 to pass signals at a frequency equal or substantially equal to $\omega_o$. If $$\frac{kE}{n}(\omega_o - \omega) << \omega_o,$$

the output signal of band filter 43 is:

$$U_{43}(t) = K\cos\left(\omega_o + \frac{kE}{n}(\omega_o - \omega)\right)t \quad (19)$$

Comparison of formula (19) with formula (14) shows that $D=K$; $\omega=\omega_o$. This shows that the output signal of VCO unit 48 can be expressed by (see formula (17):

$$U_{ref}=U_{48}(t)=K\cos n\omega_o t \quad (20)$$

Figure 6:
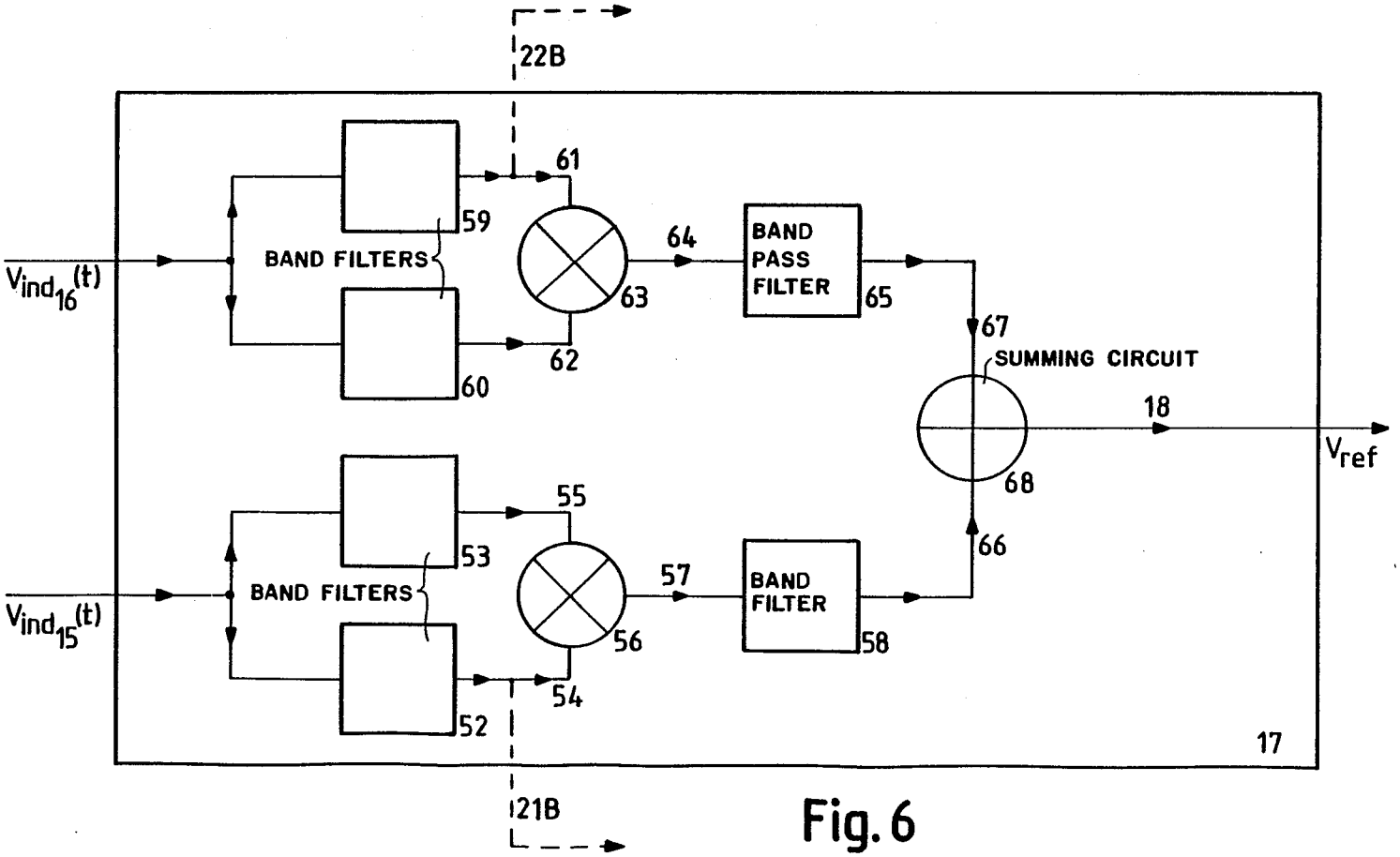
FIG. 6 is a second embodiment of a unit from FIG. 4.

A second embodiment of reference unit 17 is shown in FIG. 6, where $n=1$. With the reference unit 17 of FIG. 6 it is possible to replace lines 21A and 22A by lines 21B and 22B, respectively (see also FIG. 4). However, this is not necessary. Signal $V_{ind15}(t)$ is applied to a band filter 52 and to a band filter 53. Band filters 52 and 53 pass only signals at a frequency equal or substantially equal to $\omega_o$ and $2\omega_o$, respectively. The output signal of band filter 52 is equal to:

$$U_{52}(t)=A\sin\phi\cos\omega_o t \quad (21)$$

while the output signal of band filter 53 is equal to:

$$U_{53}(t)=B\sin\phi\cos 2\omega_o t \quad (22)$$

Because output signal $U_{52}(t)$ contains the component $\cos\omega_o t$, which is of significance to mixer 19, it is possible to apply this signal to mixer 19, instead of signal $V_{ind15}(t)$.

This is the reason why line 21A can be replaced by line 21B. Signals $U_{52}(t)$ and $U_{53}(t)$ are fed to a mixer 56 via lines 54 and 55, respectively. The output signal of mixer 56 is expressed by:

$$U_{56}(t)=AB\sin^2\phi_m(t)\cos\omega_o t\cos 2\omega_o t \quad (23)$$

This output signal is applied to a band filter 58 via line 57. The band filter passes only signals at a frequency equal or substantially equal to $\omega_o$. The output signal $U_{58}(t)$ of band filter 58 is therefore expressed by:

$$U_{58}(t) = \frac{AB}{2}\sin^2\phi_m(t)\cos\omega_o t \quad (24)$$

Analogous to the processing of signal $V_{ind16}(t)$, signal $V_{ind15}(t)$ is applied for processing to a band filter 59 passing signals at a frequency equal or substantially equal to $\omega_o$, a band filter 60 passing signals at a frequency equal or substantially equal to $2\omega_o$, a mixer 63, a line 64, and a band pass filter 65 passing signals at a frequency equal or substantially equal to $\omega_o$, to obtain the signal:

$$U_{65}(t) = \frac{AB}{2}\cos^2\phi_m(t)\cos\omega_o t \quad (25)$$

Signals $U_{58}(t)$ and $U_{65}(t)$ are fed to a summing circuit 68 via lines 66 and 67, respectively, to obtain an output signal:

$$U_{68}(t) = U_{ref}(t) = \frac{AB}{2}\cos\omega_o t \quad (26)$$

In formula (16), therefore, $$C = \frac{AB}{2}.$$

Signal $U_{68}(t)$ is applied for further processing via line 18.

It should be noted that new embodiments arise if in the entire apparatus $n\omega$ and $(n+1)\omega$ are exchanged. The embodiments here discussed are therefore some examples only.

Figure 8:
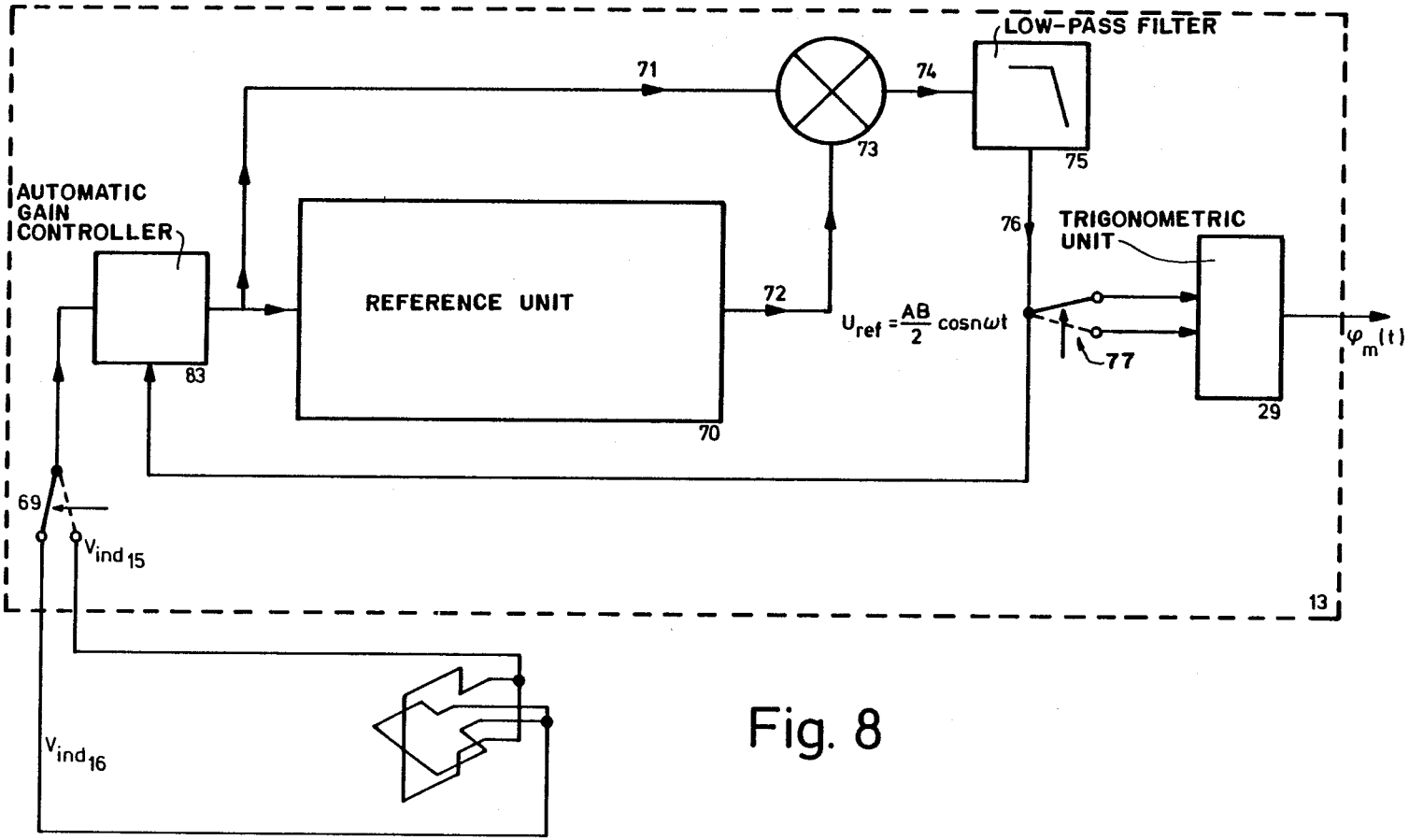
FIG. 8 shows a second embodiment of an apparatus included in a projectile to determine the projectile angular spin position.
Figure 9:
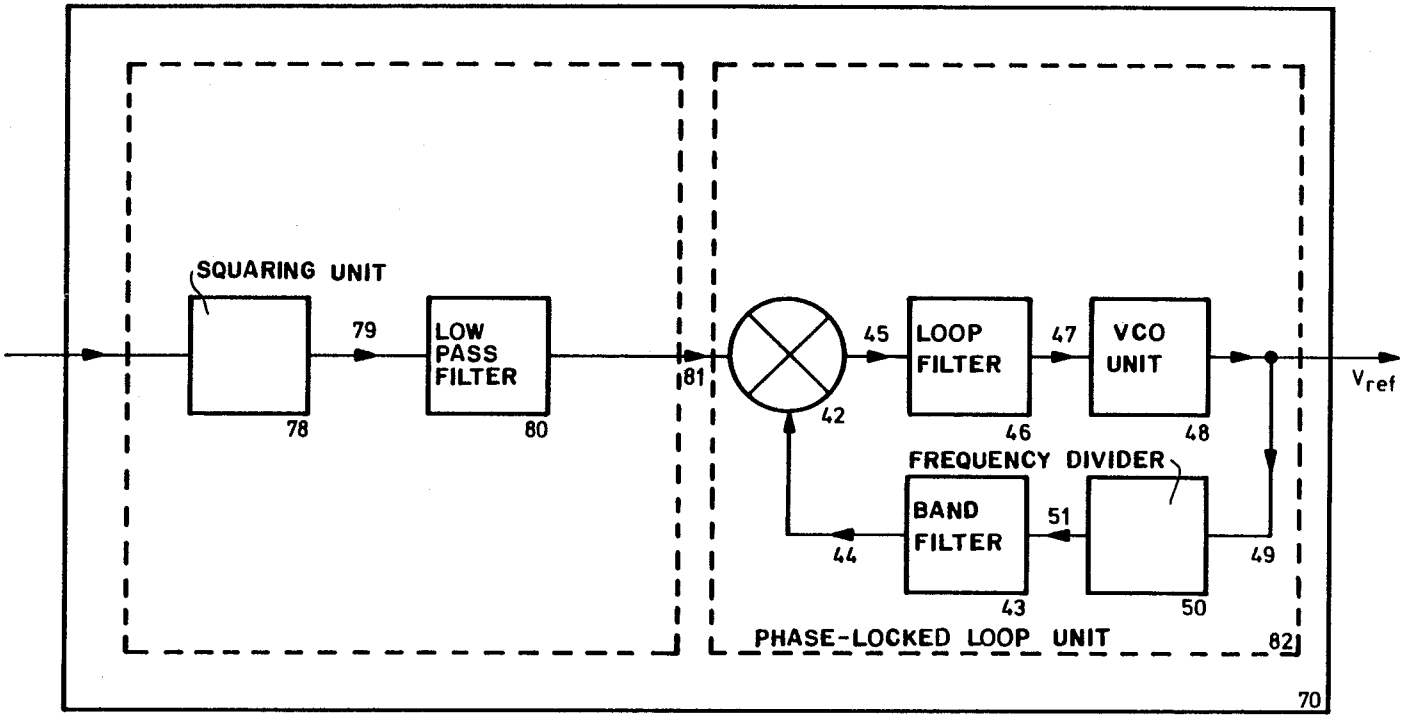
FIG. 9 shows an embodiment of a unit from FIG. 8.

A specially advantageous embodiment of the apparatus 13 is obtained if in FIGS. 4 and 5 certain circuit parts are combined by means of switching means. Such an embodiment is shown in FIGS. 8 and 9. Induction voltages $V_{ind15}(t)$ and $V_{ind16}(t)$ are supplied to a switching unit 69 of the apparatus 13. Using the switching unit 69, the induction voltages $V_{ind15}(t)$ and $V_{ind16}(t)$ are applied alternately for further processing. In general, $V_{ind15}(t)$ and $V_{ind16}(t)$ are of the form as expressed by formulas (5) and (6). A reference unit 70 generates the reference signal $U_{ref}$ from signal $V_{ind16}(t)$ or $V_{ind15}(t)$:

$$U_{ref}=C\cos n\omega t \quad (6)$$

FIG. 9 shows an embodiment of the reference unit 70. If at $t=t_o$ the switching unit 69 assumes the position indicated in FIG. 8, signal $V_{ind15}(t)$ is applied to a squaring unit 78 of reference unit 70. Squaring unit 78 generates a signal $U_{78}(t_o)=V_{ind15}(t)$, as indicated by formula (9). The output signal of squaring unit 78 is passed through a low-pass filter 80 via a line 79. Filter 80 passes only frequency components with a frequency smaller than or equal to $\omega_o$:

$$U_{80}(t_o)=AB\sin^2\phi_m(t_o).\tfrac{1}{2}\cos\omega_o t_o \quad (27)$$

If at time $t=t'_o$ the switching unit 69 assumes the position shown dotted in FIG. 8, low-pass filter 80 generates an output signal $U_{80}(t'_o)$ in a fully analogous manner:

$$U_{80}(t'_o)=AB\cos^2\phi_m(t'_o).\tfrac{1}{2}\cos\omega_o t'_o \quad (28)$$

Combination of formulas (27) and (28) yields the output signal:

$$U_{80}(t)=AB(s(t)\cos^2\phi_m(t)+(1-s(t))\sin^2\phi_m(t)).\tfrac{1}{2}\cos\omega_o t \quad (29)$$

where $s(t)$ assumes alternately the value 1 or 0 at frequency $f_s$. Signal $U_{80}(t)$ is applied to a phase-locked loop unit 82 via line 81. Phase-locked loop unit 82 is of the same design as the phase-locked loop unit 31 of FIG. 5; hence, in FIG. 9 like parts are denoted by like reference numerals (42–51). The bandpass filter 43 passes only signal components with a frequency equal or substantially equal to $\omega_o$. In relation therewith the switching frequency $f_s$ is so selected that the condition $$f_s << (2\pi)^{-1}\omega_o \quad (30)$$

is satisfied. Analogous to formulas 13–20, it can be shown that subject to condition (30):

$$U_{48}(t)=U_{ref}=C \cos n\, \omega_o t \quad (6)$$

With switching unit 69 in the position indicated in FIG. 8, the induction voltage $V_{ind15}(t)$ and the reference signal $U_{ref}$ are applied to a mixer 73 via lines 71 and 72. The output signal of mixer 73 is supplied to a low-pass filter 75 via line 74. As described for mixer 73, the output signal $U_{75}(t)$ of the low-pass filter 75 is:

$$U_{75}(t) = \frac{AC}{2} \cos\phi_m(t) \quad (31)$$

Output signal $U_{75}$ is applied to a first input of the trigonometric unit 29 via a line 76 and a switching unit 77, which assumes the position indicated in FIG. 8. With switching units 69 and 77 in the position shown dotted in FIG. 8, an output signal $U'_{75}(t')$ is supplied to a second input of trigonometric unit 29:

$$U'_{75}(t') = \frac{AC}{2} \sin\phi_m(t') \quad (32)$$

Switching units 69 and 77 are operated simultaneously at a switching frequency $f_s$. To this effect, the system can be provided with an oscillator of frequency $f_s$ not shown in FIG. 7. Frequency $f_s$ is so selected that the condition:

$$f_x >> (2\pi)^{-1} \frac{d\phi_m}{dt} \quad (33)$$

is satisfied. If this condition is satisfied, two successive signals $U_{75}(t)$ and $U'_{75}(t')$ can be expressed by:

$$U'_{75}(t') \approx U'_{75}(t) = \frac{AC}{2} \sin\phi_m(t) \quad (34)$$

For given signals $U_{75}(t)$ and $U'_{75}(t)$ the trigonometric unit determines $\phi_m(t)$ from formulas (31) and (34). Since for two successively generated signals $U'_{75}(t')$ and $U_{75}(t)$, $|t-t'|=f_s^{-1}$, a better approximation is that $\phi_m(t-\frac{1}{2}f_s^{-1})$, instead of $\phi_m(t)$, be determined. The amplitudes A and C of the received signals ($V_{ind15}(t)$ and $V_{ind16}(t)$) may still change as a function of the distance between the first and the second objects. At the same time variations in A and C may occur due to variations of atmospheric conditions. In an advantageous embodiment the system of FIG. 8 is provided with an automatic gain controller 83 for making the amplitudes of the signals in formulas (31) and (34) independent of A and C. This has the advantage that no exacting demands need be made on trigonometric unit 29.

According to the embodiment of FIGS. 4 and 5, two receiving channels are utilised. To obtain an accurate result in determining $\phi_m(t)$, the two channels need to be identical. Since in accordance with FIGS. 8 and 9 one common receiving channel is used for the processing of the signals $V_{ind15}(t)$ and $V_{ind16}(t)$, no synchronisation problems will be incurred. This has the added advantage that the determination of $\phi_m(t)$ will be highly accurate.

For an average person skilled in this art, it will be clear that many variances according to the invention are feasible.

It will also be clear that the method for determining the angular spin position of an object with the aid of two superimposed phase-locked and polarised carrier waves as reference and an apparatus according to FIG. 4 can also be used if the projectile now functioning as the first object is equipped with the transmitter and antenna unit 7, while the apparatus 13 now functioning as the second object is installed, jointly with the loop antennas, on the ground (see FIG. 7). Fully analogous to FIG. 1, the first target tracking means 3, the second target tracking means 4, and computing means 5 are used to determine the angular spin position $\phi_g$ of the projectile; this requires a course correction of the projectile 1 to hit the target 2. To determine the angular spin position of the projectile, the transmitter and antenna unit 7 are contained in the projectile 1. With the use of the loop antennas located on the ground and the apparatus 13, to which these antennas are mounted, it is possible to determine $\phi_m(t)$ in the same way as in FIG. 1, as here a relative angular spin position of the projectile with respect to the apparatus 13 is concerned. The output signal $\phi_m(t)$ of the apparatus 13 is applied to comparator 12. If the condition $\phi_m(t)=\phi_g$ is fulfilled, the comparator delivers a control signal S to transmitter unit 8. This control signal is sent out for reception by the receiver 9 in the projectile. In response to this, receiver 9 activates the gas discharge units 6. If a second course correction is found to be necessary, this entire process can repeat itself.

I claim:

1. System for determining the angular spin position of a second object spinning about an axis with respect to a first object, characterised in that the system comprises: at least two loop antennas connected to the second object; transmitting means for generating at least two superimposed phase-locked and polarised carrier waves with different frequencies; and receiving means for processing in combination the carrier waves received from said loop antennas to obtain said angular spin position.

2. System as claimed in claim 1, characterised in that the antennas consist of a first and a second perpendicularly disposed loop antenna.

3. System as claimed in claim 1 or 2, characterised in that said carrier waves consist of two superimposed phase-locked carrier waves of frequency $n\omega_o$ and $(n+1)\omega_o$, where n is a positive integer.

4. System as claimed in claims 2, characterised in that the receiving means consists of:

a. a reference unit for obtaining a reference signal from the superimposed carrier waves received via the two loop antennas, the frequency of said reference signal being equal to one of the frequencies of said carrier waves;

b. a first and a second mixer for mixing with said reference signal at least one component of said superimposed carrier waves received via the first and second loop antennas respectively;

c. a first and a second filter for filtering the output signals of said first and second mixers, said first and second filters passing only frequency components smaller than $\omega_o$;

d. a trigonometric unit controlled by the output signals of the first and the second filters, which trigonometric unit generates a signal representing the instantaneous angle between one of the loop antennas and the polarisation direction of the superimposed carrier waves.

5. System as claimed in claim 4, characterised in that the reference unit comprises:

a. a subreference unit for generating a subreference signal from the superimposed carrier waves received via the two loop antennas, the frequency of said subreference signal being equal to $\omega_o$;

b. a phase-locked loop unit supplied with the subreference signal to generate a reference signal at a frequency equal to $n\omega_o$.

6. System as claimed in claim 5, characterised in that the subreference unit comprises:

a. a first and a second squaring unit for squaring the superimposed carrier waves received via the first and the second loop antennas;

b. a third and a fourth filter for filtering the output signals of the first and the second squaring unit, respectively, to pass only signals at a frequency equal or substantially equal to $\omega_o$;

c. a summing unit for summing the output signals of the third and the fourth filters to obtain said subreference signal.

7. System as claimed in claim 4, characterised in that $n=1$ and the reference unit comprises:

a. a third and a fourth filter, the input signal of which third and fourth filters being the superimposed carrier waves received via the first and the second loop antennas, respectively, to pass only frequency components at a frequency equal or substantially equal to $\omega_o$;

b. a fifth and a sixth filter, the input signal of which fifth and sixth filters being the superimposed carrier waves received via the first and the second loop antennas, respectively, to pass only frequency components at a frequency equal or substantially equal to $2\omega_o$;

c. a third and a fourth mixer for mixing the output signals of the third and the fifth and the fourth and the sixth mixers, respectively;

d. a seventh and an eighth filter for filtering the output signal of the third and the fourth mixers, respectively, to pass only frequency components at a frequency equal or substantially equal to $\omega_o$;

e. a summing unit for summing the output signals of the seventh and the eighth filters to obtain said reference signal.

8. System as claimed in claim 5 or 7, characterised in that the input signals of the first and the second mixers consist of the superimposed carrier waves received via the first and the second loop antennas, respectively.

9. System as claimed in claim 8, characterised in that the input signal of the first and the second filters consists of the output signal of the third and the fourth filters, respectively.

10. System as claimed in claims 2, characterised in that the receiving means consists of:

a. a reference unit for obtaining a reference signal from the superimposed carrier waves received via at least one of the two loop antennas, the frequency of said reference signal being equal to one of the frequencies of said carrier waves;

b. a first switching unit for alternately selecting the output signals of one of the two loop antennas;

c. a mixer for mixing with said reference signal at least one component of said superimposed carrier waves received via the first loop antenna;

d. a filter for filtering the output signal of said mixer, said filter passing only frequency components smaller than $\omega_o$;

e. a second switching unit for selecting synchronously with the first switching unit the output signal of the filter;

f. a trigonometric unit controlled by the output signals of the second switching unit, which trigonometric unit generates a signal representing the instantaneous angle between one of the loop antennas and the polarisation direction of the superimposed carrier waves.

11. System as claimed in claim 10, characterised in that the reference unit comprises:

a. a subreference unit for generating a subreference signal from the superimposed carrier waves received from the first switching unit, the carrier frequency of said subreference signal being equal to $\omega_o$;

b. a phase-locked loop unit supplied with the subreference signal to generate a reference signal at a frequency equal to $n\omega_o$.

12. System as claimed in claim 11, characterised in that the subreference unit comprises:

a. a squaring unit for squaring the superimposed carrier waves received from the first switching unit;

b. a filter for filtering the output signals of the squaring unit, to pass only signals at a frequency smaller than or equal to $\omega_o$ to obtain said subreference signal.

13. System as claimed in claim 2, in which the second object consists of a projectile, characterised in that said antennas are connected to the projectile on the side turned away from the direction of flight.

14. System as claimed in claim 4 or 10, characterised in that the trigonometric unit consists of a table look-up generator for generating the $\phi$ value from two input signals, $A \cos \phi$ and $A \sin \phi$.

15. System as claimed in claim 4 or 10, characterised in that the trigonometric unit consists of a computing unit for computing the $\phi$ value from two input signals $A \cos \phi$ and $A \sin \phi$.

* * * * *